US012774500B2

(12) United States Patent
Rehman et al.

(10) Patent No.: US 12,774,500 B2
(45) Date of Patent: Oct. 27, 2026

(54) METHOD FOR PRODUCING LIGHT GAUGE STEEL

(71) Applicant: Algoma Steel Inc., Sault Sainte Marie (CA)

(72) Inventors: Kashif Rehman, Sault Sainte Marie (CA); John Naccarato, Sault Sainte Marie (CA)

(73) Assignee: Algoma Steel Inc., Sault Sainte Marie (CA)

( * ) Notice: Subject to any disclaimer, the term of this patent is extended or adjusted under 35 U.S.C. 154(b) by 599 days.

(21) Appl. No.: 17/580,017

(22) Filed: Jan. 20, 2022

(65) Prior Publication Data

US 2022/0228234 A1 Jul. 21, 2022

Related U.S. Application Data

(60) Provisional application No. 63/139,381, filed on Jan. 20, 2021.

(51) Int. Cl.

| | |
|---|---|
| ***C21D 1/18*** | (2006.01) |
| ***C21D 8/0221*** | (2026.01) |
| ***C21D 8/0247*** | (2026.01) |
| ***C21D 9/46*** | (2006.01) |
| ***C21D 9/52*** | (2006.01) |

(52) U.S. Cl.
CPC ..... *C21D 1/18* (2013.01); *C21D 8/0226* (2013.01); *C21D 8/0263* (2013.01); *C21D 9/46* (2013.01); *C21D 9/52* (2013.01)

(58) Field of Classification Search
CPC ... C21D 9/52; C21D 9/46; C21D 1/18; C21D 9/00; C21D 1/6667; C21D 8/0226; C21D 8/0263
See application file for complete search history.

(56) References Cited

U.S. PATENT DOCUMENTS 2,303,096 A * 11/1942 Thaden ..... B21D 1/00 72/164
2,526,296 A * 10/1950 Stone ..... C21D 7/10 72/183
3,554,513 A * 1/1971 Chance ..... C21D 9/573 148/703
4,016,740 A * 4/1977 Gondo ..... C21D 8/02 72/364
4,751,838 A * 6/1988 Voges ..... B21D 1/00 72/302
5,110,379 A * 5/1992 Finkl ..... C22C 38/22 148/333
5,579,658 A * 12/1996 Noe ..... B21D 1/05 72/205
8,419,869 B1 * 4/2013 Branagan ..... C22C 38/34 148/330
2002/0104597 A1 * 8/2002 Frank ..... C21D 8/0226 148/547
2015/0041024 A1 * 2/2015 Schulz ..... C21D 9/0068 148/645
2016/0369362 A1 * 12/2016 Abrahams ..... C21D 6/005
2018/0044759 A1 * 2/2018 Schulz ..... C21D 1/26
2019/0316222 A1 * 10/2019 Schulz ..... C23C 2/40

FOREIGN PATENT DOCUMENTS

CH 102776428 A * 11/2012 ..... C22C 1/04
CN 102392107 A * 3/2012
PL 214816 B1 * 9/2013 ..... C21D 9/42

OTHER PUBLICATIONS

Satyendra, 2013, "Reheating Furnaces and their Types," https://www.ispatguru.com/reheating-furnaces-in-steel-plants/ (Year: 2013).*
Stretcher Levelers, by Red Bud Industries, published Sep. 14, 2017, retrieved Jun. 14, 2017, from URL https://web.archive.org/web/20170914045634/https://redbudindustries.com/stretcher-levelers/ (Year: 2017).*
Weldability of Modern High Strength Steels, N. Yurioka (Year: 1990).*
Satyendra, 2013, âReheating Furnaces and their Types,â https://www.ispatguru.com/reheating-furnaces-in-steel-plants/ (Year: 2013).*
17580017_2024-06-12_CN_102392107_A_M.pdf, Machine translation of CN-102392107-A (Year: 2012).*
Ginzburg, Vladimir B. "Steel-Rolling Technology: Theory and Practice." Taylor & Francis Group. pp. 165-185. (Year: 1989).*
The Engineering ToolBox. Brinell Hardness Number—BHN. [online] Available at: https://www.engineeringtoolbox.com/bhn-brinell-hardness-number-d_1365.html [Accessed Oct. 15, 2025]. (Year: 2008).*
Association for Iron & Steel Technology. "Principles of Hot Rolling." 48 pages. Available at: https://www.aist.org/AIST/aist/AIST/Conferences_Exhibitions/Training_Seminars/Training%20Presentations/10-Hot-Rolling-Processes-msts-20.pdf [Accessed Oct. 15, 2025] (Year: 2020).*
CN102776428A machine translation of the description (Year: 2012).*
PL 214816 B1 machine translation of description (Year: 2013).*
Tec-Science. "Quenching and Tempering of Steel." Downloaded Feb. 11, 2026 from https://www.tec-science.com/material-science/heat-treatment-steel/quenching-and-tempering/#:~:text=Quensching%20and%20tempering%20can%20be,moderate%20temperatures%20with%20slow%20cooling (Year: 2018).*

* cited by examiner

*Primary Examiner* — Tima M. McGuthry-Banks
(74) *Attorney, Agent, or Firm* — Dinsmore & Shohl LLP

(57) ABSTRACT

The method is for use with a strip or plate of steel, the steel being of a composition and temperature suitable for heat treatment, and comprising the following steps: austenizing the strip or plate to produce austenitized material; quenching the austenized material to produce hardened steel; thermally tempering the hardened steel to produce tempered steel; and stretching and leveling the tempered steel to produce heat treated steel.

13 Claims, No Drawings

METHOD FOR PRODUCING LIGHT GAUGE STEEL

CROSS REFERENCE TO RELATED APPLICATIONS

This application depends from and claims priority to U.S. Provisional Application No. 63/139,381 filed Jan. 20, 2021, the entire contents of which are incorporated herein by reference.

FIELD

The invention relates to the field of light gauge steel production.

BACKGROUND

Light gauge heat-treated steel has many uses in industry. One type of such steel known as advanced high strength steel sheet (AHSS) is widely used, for example, in automotive applications. Another type of such steel known as hardened steel plate (HTP) is widely used in wear applications such as mining, earth-moving and heavy vehicles such as dump trucks.

Known technologies for the production of light gauge heat-treated steel are relatively expensive as such steels are traditionally produced on expensive process lines with in-line advanced cooling technologies.

SUMMARY OF THE INVENTION

Forming one aspect of the invention is a method for use with a strip or plate of steel, the steel being of a composition and temperature suitable for heat treatment, the method comprising the following steps:

- austenizing the steel to produce austenitized material;
- quenching the austenized material to produce hardened steel;
- thermally tempering the hardened steel to produce tempered steel; and
- stretching and leveling the tempered steel to produce heat treated steel.

According to another aspect, the stretching and leveling of the hardened steel can be carried out using a stretcher leveler.

According to another aspect, the steel can be austenized in a reheat furnace.

According to another aspect, the austenized material can be quenched using a water quench process.

According to another aspect, the steel can be cut into daughter lengths prior to austenizing.

According to another aspect, the tempered steel can be cooled prior to the stretching and leveling process that results in the heat treated steel.

According to another aspect, the heat treated steel can be cut into blanks.

According to another aspect, the stretcher leveler can be defined by a T4 stretcher leveler.

According to another aspect, the strip or plate can be produced by rolling a slab through a hot reduction mill.

Advantages, features and characteristics of the present invention will become apparent to persons of ordinary skill in the art upon review of the description which follows.

DETAILED DESCRIPTION OF A NON-LIMITING EMBODIMENT

A method for producing light gauge steel according to a non-limiting embodiment of the invention consists of the following steps:

- liquid steel, having a chemistry suitable for heat treatment, is cast into a slab;
- the slab is rolled through a hot reduction mill into a master coil or master discrete plate and allowed to cool;
- the cooled master coil or master discrete plate is cut into specified daughter lengths;
- the daughter lengths are austenized in a reheat furnace and then quenched in water; and
- the now-hardened daughter lengths are passed through a T4 stretch leveller and cut into blanks for further forming, profiling, or otherwise fabrication into finished parts.

Examples of suitable steel materials that may be used in the processes as provided herein include but are not limited to those sold by Algoma Steel, Inc., Ontario. Canada. Illustratively a steel is Algoma 100 steel as provided in Table 1:

TABLE 1

| Chemical Composition-Heat Analysis (% maximum) | | | | | | | | |
|---|---|---|---|---|---|---|---|---|
| Thickness | C | Mn | P | S | Si | Cr | Mo | B |
| 0.188" (5 mm) to 0.250" (6.35 mm) | 0.17 | 1.5 | 0.03 | 0.015 | 0.45 | 0.25 | 0.2 | 0.003 |
| Over 0.250" (6.35 mm) to 1.00" (25.4 mm) | 0.21 | 1.5 | 0.03 | 0.015 | 0.45 | 0.2 | 0.2 | 0.003 |
| Over 1.00" (25.4 mm) to 2.75" (70 mm) | 0.21 | 1.5 | 0.03 | 0.015 | 0.45 | 0.65 | 0.4 | 0.003 |

The steel of Table 1 has a minimum tensile strength of 110 ksi, a maximum tensile strength of 130 ksi, a yield strength of 100 ksi, and an elongation (percent) minimum in 2 inches of 16.

Illustratively a steel is Algoma 130 steel as provided in Table 2:

TABLE 2

| Chemical Composition-Heat Analysis (% maximum) | | | | | | | | |
|---|---|---|---|---|---|---|---|---|
| Thickness | C | Mn | P | S | Si | Cr | Mo | B |
| 0.188" (5 mm) to 0.250" (6.35 mm) | 0.17 | 1.5 | 0.025 | 0.015 | 0.45 | 0.2 | 0.2 | 0.003 |
| Over 0.250" (6.35mm) to 1.375" (35 mm) | 0.21 | 1.5 | 0.025 | 0.015 | 0.45 | 0.65 | 0.4 | 0.003 |
| Over 1.375" (35 mm) to 2.5" (65 mm) | 0.26 | 1.5 | 0.025 | 0.015 | 0.45 | 0.6 | 0.45 | 0.003 |

The steel of Table 2 has a minimum tensile strength of 136 ksi, a yield strength of 130 ksi, and an elongation (percent) minimum in 2 inches of 12.

Illustratively a steel is AlgoTuf 400F steel as provided in Table 3:

TABLE 3

| Chemical Composition-Heat Analysis (% maximum) | | | | | | | | |
|---|---|---|---|---|---|---|---|---|
| Thickness | C | Mn | P | S | Si | Cr | Mo | B |
| 0.188" (5 mm) to less than 0.472" (12 mm) | 0.17 | 1.5 | 0.025 | 0.015 | 0.45 | 0.2 | 0.2 | 0.003 |
| 0.472" (12 mm) to 0.787" (20 mm) | 0.17 | 1.5 | 0.025 | 0.015 | 0.45 | 0.25 | 0.2 | 0.003 |
| Over 0.787" (20 mm) to 1.00" (25.4 mm) | 0.2 | 1.5 | 0.025 | 0.015 | 0.45 | 0.6 | 0.35 | 0.003 |
| Over 1.00" (25.4 mm) to 2.75" (70 mm) | 0.26 | 1.5 | 0.025 | 0.015 | 0.45 | 0.6 | 0.45 | 0.003 |

The steel of Table 3 has a minimum tensile strength of 175 ksi, a yield strength of 145 ksi, and an elongation (percent) minimum in 2 inches of 15.

Illustratively a steel is AlgoTuf 450F steel as provided in Table 4:

TABLE 4

| Chemical Composition-Heat Analysis (% maximum) | | | | | | | | |
|---|---|---|---|---|---|---|---|---|
| Thickness | C | Mn | P | S | Si | Cr | Mo | B |
| 0.188" (5 mm) to 0.394" (10 mm) | 0.21 | 1.5 | 0.025 | 0.015 | 0.45 | 0.2 | 0.2 | 0.003 |
| Over 0.394" (10 mm) to 0.787" (20 mm) | 0.23 | 1.5 | 0.025 | 0.015 | 0.45 | 0.2 | 0.35 | 0.003 |
| Over 0.787" (20 mm) to 2.5" (65 mm) | 0.26 | 1.5 | 0.025 | 0.015 | 0.45 | 0.6 | 0.45 | 0.003 |

The steel of Table 4 has a minimum tensile strength of 200 ksi and an elongation (percent) minimum in 2 inches of 14.

Illustratively a steel is AlgoTuf 450F steel as provided in Table 5:

TABLE 5

| Chemical Composition-Heat Analysis (% maximum) | | | | | | | | | |
|---|---|---|---|---|---|---|---|---|---|
| Thickness | C | Mn | P | S | Si | Cr | Mo | Ni | B |
| 0.236" (6 mm) to 1.25" (31.75 mm) | 0.33 | 1.5 | 0.025 | 0.015 | 0.5 | 0.7 | 0..5 | 0.7 | 0.003 |

The steel of Table 5 has a typical tensile strength of 255 ksi and an elongation (percent) typical in 2 inches of 14.

Illustratively, a steel is Armour steel with the following characteristics at a thickness of 6 mm to 31.75 mm:

| Chemical composition (%) unless a range is specified individual values are maximums | |
|---|---|
| Carbon | 0.22-0.32 |
| Maganese | 0.60-0.90 |
| Phosphorous | 0.02 |
| Sulfur | 0.01 |
| Silicon | 0.2-0.4 |
| Chromium | 0.4-0.7 |
| Nickel | 0.35-0.85 |
| Molybdenum | 0.2-0.35 |
| Copper | 0.25 |
| Boron | 0.003 |

-continued

| Chemical composition (%) unless a range is specified individual values are maximums | |
|---|---|
| Hardness (HBW) (average) | 477-534 |
| CVNL full size min. avg. impact (ft-lbs) @ −40 degrees F. | 14 |
| CVNT full size min. avg. impact (ft-lbs) @ −40 degrees F. | 12 |
| Heat Treatment Requires | Q&T |

EXPERIMENTAL

A slab was cast for 387-418 BHN grade and was passed through the hot rolling mill at Algoma, Ontario. The coil was later cut to length into master plates at Algoma's CTL facility. A resultant plate of dimensions 0.1891"×72"×240" was austenized in a reheat furnace and then sprayed with water so as to get quenched. The quenched plate had a 0.5" wave every 28" and had a yield strength of about 163,000 psi, tensile strength of about 198,000 psi and elongation of about 11%. The wave is attributed to uneven cooling rate across the three dimensions. The plate was levelled on a T4 stretcher leveler of a type sold by RedBud Industries for a total of 3.7". The resultant plate surprisingly turned out to be quite flat.

Persons of ordinary skill will also readily appreciate the process is advantageous in that, inter alia, it:

- permits the production of AHSS and HTP without the expense associated with a a discrete plate leveler; and
- is relatively easily replicated in comparison to known processes for production of AHSS and HTP given that the operator is largely required merely to ensure that the strip/plate is pulled to a definite stroke length.

Whereas a single example is herein described, persons of ordinary will appreciate that the process can be varied widely. For example, any conventional steel alloy used in the production of AHSS and HTP can be used, material of varying size can be used and greater or lesser amounts of stretching will be employed, based upon the starting shape. Accordingly, the invention should be understood to be limited only by the accompanying claims, purposively construed.

The invention claimed is:

1. A method for use with a plate of steel, the steel being of a composition and temperature suitable for heat treatment, the method comprising the following steps:

- austenizing the plate of steel to produce austenitized material;
- quenching the austenized material to produce hardened steel;
- thermally tempering the hardened steel to produce tempered steel; and
- stretching and leveling the tempered steel to produce heat treated steel plate using a stretcher leveler to reduce a thickness of the tempered steel to a thickness equal to or greater than 5 mm and equal to or less than 70 mm, and wherein:

- the plate of steel comprises carbon equal to or greater than 0.24 wt % and less than or equal to 0.33 wt %.

2. The method according to claim 1, wherein the plate of steel is austenized in a reheat furnace.

3. The method according to claim 2, wherein the austenized material is quenched using a water quench process.

4. The method according to claim 3, wherein the tempered steel is cooled prior to the stretching and leveling process that results in the heat treated steel.

5. The method according to claim 1, wherein the heat treated steel is cut into blanks.

6. The method according to claim 1, wherein the plate of steel is produced by rolling a slab through a hot reduction mill.

7. The method according to claim 1, wherein the hardened steel, prior to stretching and leveling, has a yield strength of about 163,000 psi, tensile strength of about 198,000 psi and elongation of about 11%.

8. The method according to claim 1, wherein the plate of steel is grade 387-418 BHN.

9. The method according to claim 1, wherein the plate of steel has a thickness equal to or less than 94 mm.

10. The method according to claim 1, wherein the plate of steel comprises carbon equal to or less than 0.32 wt %.

11. The method according to claim 1, wherein the plate of steel has a minimum tensile strength of at least 110 ksi.

12. The method according to claim 1, wherein the plate of steel has a maximum tensile strength of at least 130 ksi.

13. The method according to claim 1, wherein the plate of steel has a yield strength of at least 100 ksi.

* * * * *